US010816017B2

(12) United States Patent
McInally

(10) Patent No.: US 10,816,017 B2
(45) Date of Patent: Oct. 27, 2020

(54) DOWNHOLE TRACTOR COMPRISING AN IMPROVED HYDRAULIC SYSTEM

(71) Applicant: Altus Intervention (Technologies) As, Stavanger (NO)

(72) Inventor: Gerald McInally, Bryne (NO)

(73) Assignee: Altus Intervention (Technologies) AS, Stavanger (NO)

( * ) Notice: Subject to any disclaimer, the term of this patent is extended or adjusted under 35 U.S.C. 154(b) by 0 days.

(21) Appl. No.: 16/609,678

(22) PCT Filed: Jun. 12, 2018

(86) PCT No.: PCT/NO2018/050151
§ 371 (c)(1),
(2) Date: Oct. 30, 2019

(87) PCT Pub. No.: WO2019/004834
PCT Pub. Date: Jan. 3, 2019

(65) Prior Publication Data

US 2020/0200194 A1 Jun. 25, 2020

(30) Foreign Application Priority Data

Jun. 30, 2017 (NO) ..... 20171083

(51) Int. Cl.
*F15B 11/20* (2006.01)
*F15B 11/16* (2006.01)
(Continued)

(52) U.S. Cl.
CPC ..... *F15B 11/20* (2013.01); *F15B 11/161* (2013.01); *F15B 11/17* (2013.01); *F15B 15/18* (2013.01);
(Continued)

(58) Field of Classification Search
CPC ..... F15B 11/16; F15B 11/161; F15B 11/17; F15B 11/20; F15B 11/22; F15B 15/18;
(Continued)

(56) References Cited

U.S. PATENT DOCUMENTS 3,987,623 A * 10/1976 Bianchetta ..... F15B 11/17 60/422
6,170,261 B1 * 1/2001 Ishizaki ..... F15B 11/17 60/421
(Continued)

FOREIGN PATENT DOCUMENTS

EP 0110182 A2 6/1984
EP 2505772 A1 3/2012
(Continued)

*Primary Examiner* — Michael Leslie
(74) *Attorney, Agent, or Firm* — Gable Gotwals

(57) ABSTRACT

A downhole tractor having a hydraulic system for driving a plurality of hydraulic cylinders and a plurality of hydraulic motors. The system comprises: a hydraulic power pack; a first hydraulic supply line for supplying hydraulic fluid to the plurality of hydraulic cylinders; a second hydraulic supply line for supplying hydraulic fluid to plurality of hydraulic motors; a valve section comprising a respective part of first hydraulic supply line and a further respective part of second hydraulic supply line, valve section further comprising an inlet for receiving hydraulic fluid, and a set of valves, and a hydraulic bypass supply line coupled to hydraulic power pack for supplying hydraulic fluid directly to the inlet of valve section bypassing at least part of first hydraulic supply line and second hydraulic supply line. The first and the second hydraulic supply line each comprise two parts connected via respective part in the valve section. Each respective part is connected to a respective sub-set of plurality of hydraulic components. The valve section configured for individually controlling flow of hydraulic fluid into each respective part of hydraulic supply lines.

10 Claims, 9 Drawing Sheets

(51) Int. Cl.
*F15B 11/17* (2006.01)
*F15B 15/18* (2006.01)

(52) U.S. Cl.
CPC ..... *F15B 2211/40553* (2013.01); *F15B 2211/6052* (2013.01); *F15B 2211/6055* (2013.01)

(58) Field of Classification Search
CPC .... F15B 2211/40553; F15B 2211/6052; F15B 2211/6055
See application file for complete search history.

(56) References Cited

U.S. PATENT DOCUMENTS

| | | | | |
|---|---|---|---|---|
| 6,273,189 | B1 * | 8/2001 | Gissler | E21B 4/18 166/241.1 |
| 7,946,358 | B2 * | 5/2011 | Hallundbæk | F15B 13/07 60/426 |
| 9,091,281 | B2 * | 7/2015 | Quinnell | F15B 11/17 |
| 2019/0040700 | A1 * | 2/2019 | McInally | E21B 23/04 |
| 2019/0119884 | A1 * | 4/2019 | Horii | E02F 9/2004 |
| 2019/0219072 | A1 * | 7/2019 | McInally | F15B 11/20 |

FOREIGN PATENT DOCUMENTS

| | | | |
|---|---|---|---|
| NO | 20160278 | A1 | 2/2016 |
| NO | 20161606 | A1 | 4/2018 |

* cited by examiner

DOWNHOLE TRACTOR COMPRISING AN IMPROVED HYDRAULIC SYSTEM

CROSS-REFERENCE TO RELATED APPLICATIONS

This United States application is the National Phase of PCT Application No. PCT/N02018/050151 filed 12 Jun. 2018, which claims priority to Norwegian Patent Application No. 20171083 filed 30 Jun. 2017, each of which is incorporated herein by reference.

FIELD OF THE INVENTION

The invention relates to a downhole tractor comprising an improved hydraulic system for driving a plurality of hydraulic cylinders and a plurality of hydraulic motors.

BACKGROUND OF THE INVENTION

Downhole tractors are typically used in the petroleum industry to gain access and perform operations inside oil wells. Downhole tractors are used as a conveyance platform to transport other well logging or well intervention equipment into the otherwise inaccessible highly deviated or horizontal sections of oil wells. In addition, downhole tractors can be used as a conveyance platform for milling and rotational equipment—not only in highly deviated and horizontal sections of oil wells, but also in more vertical sections. Milling and rotational equipment needs to be held in position, both in the axis of the well bore but also in against counter rotation torque generated by the milling bit rotation. Also especially for milling, the amount of force applied in an axial direction to the milling bit needs to be carefully controlled to provide the most effective milling action. The downhole tractor can provide both of these anchoring and weight on bit functions, in addition to acting as a general conveyance platform as described earlier.

There are a number of challenges in the operation of current downhole tractor technology, which are critical for the success or performance of a tractor conveyed operation.

- The speed at which the tractor can convey its payload in and out of the oil well is a key performance factor, i.e. the faster the job can be completed safely, the less valuable rig time is used and the faster the oil well can be put back into operation, which means less cost overhead for the oil well operator.
- In an oil well construction there can be many different completion elements such as transitions in tubing size, side pocket mandrel, sliding sleeves, etc. These elements may obstruct the tractor from progressing past such obstacle. This may limit the scope of use of tractors in some oil wells.
- For challenging tractor conveyed milling operations, total operator control of all milling parameters, including the axial force applied to the bit and optimizing the available torque of the milling motor, are very important for the success of the operation, but current tractor technology has limitations in the amount of control available.

A typical downhole tractor with hydraulic drive consists of the following elements, normally connected together in the following order: a control section with controls switching on and off the tractor function (either electronically or by mechanical means), a downhole motor (electrically powered or fluid driven turbine), a hydraulic pump with one or more outlets, and a manifold block which controls the hydraulic functions, such as maximum pump pressure and the sequential deployment of the pump outputs. These elements constitute a hydraulic 'power pack' whose output consists of one or more controlled hydraulic supply lines and a hydraulic fluid return line.

Normally the tractor drive sections are modules, which can be added in parallel to the hydraulic supply lines provided by the power pack, so that sections can be added or removed as required. Due to the modular nature of the construction, drive sections can be added to provide more pulling force as needed, but although this does give more driving force for the same pump output pressure, it also means that more motors are consuming the available pump flow so that the available flow per motor reduces and thereby the conveyance speed of the tractor reduces.

With this type of construction in the current art, the tractor is built up from a certain number of modules based on the predicted job maximum requirements, but there is very little or no control of the configuration once the tractor is deployed in the well.

Non-prepublished patent application NO20160278 A1/PCT/NO2017/050017, owned by the same applicant, discloses a downhole tractor comprising a hydraulic supply line for actuating hydraulic components. The downhole tractor further comprises a hydraulic power pack coupled to the hydraulic supply line, at least one hydraulic component and at least one further hydraulic component. Said hydraulic components are coupled to the hydraulic supply line in parallel and configured for being actuated by the hydraulic supply line. The hydraulic supply line comprises a controllable valve placed at a location in between the at least one hydraulic component and the at least one further hydraulic component such that a first part of the hydraulic supply line is coupled to a second part of the hydraulic supply line via the controllable valve.

The downhole tractor as disclosed in NO20160278A1 provides for a much better control of the downhole tractor and facilitates tuning the performance of the tractor to the actual needs. The addition of the controllable valve in the hydraulic supply line as envisaged in this patent application, makes it possible to couple the second part to the first part in a first operational mode (rendering all hydraulic components active) and for decoupling the second part from the first part in a second operational mode (rendering the at least one further hydraulic components deactivated). Referring to the tractor performance requirements as previously described, this technical measure makes it possible to control downhole tractor performance in an advantageous manner, which was not possible before. For instance, when the hydraulic components are hydraulic motors each driving a tractor wheel, then the tractor may switch between, for instance, 2-wheel drive at high conveyance speed with low pulling force, and, for instance, all-wheel (4-wheel) drive at low conveyance speed with high pulling force.

Non-prepublished patent application NO20161606A1, owned by the same applicant, discloses a downhole tractor having at least one hydraulic drive section, comprising a first hydraulic supply line for actuating at least one hydraulic cylinder for actuating at least one tractor arm and a second hydraulic supply line for driving at least one hydraulic motor for rotating at least one tractor wheel. The downhole tractor further comprises a hydraulic power pack configured for supplying hydraulic fluid to the hydraulic supply lines. The hydraulic power pack comprises a pressure-setting valve provided in between the first hydraulic supply line and the second hydraulic supply line, wherein the pressure-setting valve is configured for feeding excess hydraulic fluid in the first hydraulic supply line to the second hydraulic supply line to increase the speed of the downhole tractor.

Despite the developments discussed above there is a need for further improving downhole tractor technology in order to have better control on the wireline tractor performance.

SUMMARY OF THE INVENTION

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect the invention relates to a downhole tractor comprising a hydraulic system for driving a plurality of hydraulic cylinders and a plurality of hydraulic motors. The hydraulic system comprises: i) a hydraulic power pack; ii) a first hydraulic supply line for supplying hydraulic fluid to the plurality of hydraulic cylinders; iii) a second hydraulic supply line for supplying the hydraulic fluid to the plurality of hydraulic motors; iv) a valve section comprising respective parts of said hydraulic supply line, and an inlet for receiving the hydraulic fluid, and a set of valves and v) a hydraulic bypass supply line coupled to the hydraulic power pack for supplying the hydraulic fluid directly to the inlet of the valve section bypassing at least part of the first hydraulic supply line and the second hydraulic supply line. The first hydraulic supply line comprises a first part and a second part that are connected via the valve section, wherein the first part of the first hydraulic supply line is connected to a sub-set of the plurality of hydraulic cylinders, wherein the second part of the first hydraulic supply line is connected to a further sub-set of the plurality of hydraulic cylinders. The second hydraulic supply line comprises a first part and a second part that are connected via the valve section, wherein the first part of the second hydraulic supply line is connected to a sub-set of the plurality of hydraulic motors, wherein the second part of the second hydraulic supply line is connected to a further sub-set of the plurality of hydraulic motors. The valve section is configured for individually controlling flow of the hydraulic fluid into each respective part of the hydraulic supply lines.

The effects of the method in accordance with the invention are as follows.

A first important feature of the invention is the valve section, which is placed in a special location in the downhole tractor, namely such that it divides the hydraulic supply lines in parts, wherein each part is configured for supplying hydraulic fluid to a sub-set of respective hydraulic cylinders and motors.

A second important feature of the invention is the hydraulic bypass supply line. The main feature of the hydraulic bypass supply line is that it runs from the hydraulic power pack to the valve section bypassing at least part of the first hydraulic supply line and the second hydraulic supply line.

A third important feature of the invention is that the valve section is configured for individually controlling flow of the hydraulic fluid into each respective part of the hydraulic supply lines. This in combination with the hydraulic bypass supply line makes it now possible to, for example, feed hydraulic fluid to the lower drive sections and not the upper drive sections. This was not possible before and is rendered possible by the invention.

The invention herewith enables to make a downhole tractor that has a large quantity of different operational modes, such that the performance of the downhole tractor can be tuned towards the actual need of the operations to be carried out. More information about the various operational modes of the downhole tractor will be given in the detailed description of the figures.

The invention enables to rearrange and reconfigure the downhole tractor. In fact, the invention renders the downhole tractor more reliable and reduces the required tractor length in situations where tandem tractors (i.e. two tractors connected in series) was the only option to pass obstacle in the wellbore. The tractor may be supplemented with built-in sensors (such as pressure sensors) and a communication module (telemetry module) that enables to transfer sensor readings from the tool to the operator. In this way the operator can adjust the tractor settings and control software in order to adapt to local circumstances and surroundings of the downhole tractor, such that its operation is optimized for entering. Furthermore, the configuration and operation can be optimized for downhole mechanical tasks, such as wellbore cleaning, anchoring, wellbore milling tasks, freeing stuck tool strings, and assisting pulling out of hole.

In order to facilitate understanding of the invention one or more expressions are further defined hereinafter.

Wherever the wording "hydraulic supply line" is used, this refers to either a unidirectional hydraulic supply line or a bidirectional hydraulic supply line. In case of a unidirectional hydraulic supply line, there is also a return line connected to connected hydraulic components for delivering the hydraulic fluid back to a hydraulic tank. In case of a bidirectional hydraulic supply line, the hydraulic fluid is delivered back to the hydraulic tank through the hydraulic supply line itself (typically, a sequence valve needs to be switched to its other mode for reversing the hydraulic fluid flow). It is also important to note that the hydraulic supply line may be a main hydraulic supply line or a branch thereof, which supplies hydraulic fluid to further hydraulic components (hydraulic cylinders, hydraulic motors, relief valves, etc.). The principle of the invention still applies in such cases.

Wherever the wording "drive section" is used, this is interpreted to be as the assembly of one hydraulic cylinder driving one hydraulic arm, and one hydraulic motor driving one wheel mounted on the hydraulic arm. In a downhole tractor these parts are typically provided in a single module, which can be cascaded to form a chain of modules, typically four or more.

Wherever the wording "hydraulic power pack" is used, this refers to the electric or hydraulic motor and hydraulic pump block and a manifold block, which comprises valves for selectively dumping said hydraulic supply lines to tank. The hydraulic power pack in accordance with embodiments of the invention may be changed as will be discussed in the detailed description of the figures.

Wherever the word "tank" is used this is basically referring to the hydraulic return line system that is distributed over the downhole tractor.

In an embodiment of the downhole tractor in accordance with the invention the valve section comprises a pressure-setting valve, such as a 3-port sequence valve, provided in between the respective part of the first hydraulic supply line and the respective part of the second hydraulic supply line. The pressure-setting valve is configured for feeding excess hydraulic fluid in the first hydraulic supply line to the second hydraulic supply line. The pressure-setting valve in this embodiment is very convenient, because it allows the second hydraulic valve to be fed by via the hydraulic bypass supply line and the first hydraulic supply line. This feature as such is an extension of the invention as disclosed in the earlier discussed non-prepublished patent application NO20161606A1, owned by the same applicant. In that invention excess hydraulic fluid is led to the second hydraulic supply line in order to increase the hydraulic flow in the second hydraulic supply line for increasing the tractor speed. In the current embodiment of the current invention the excess hydraulic fluid may be effectively used to feed the second hydraulic supply line, even in the absence of the second hydraulic supply. This offers a great extra flexibility to the downhole tractor.

In an embodiment of the downhole tractor in accordance with the invention the valve section comprises respective valves placed in said hydraulic supply lines for allowing individual control of the flow of the hydraulic fluid into each respective part of the hydraulic supply lines. This feature is an extension of the invention as disclosed in the earlier discussed non-prepublished patent application NO20160278A1, owned by the same applicant. In that invention a controllable valve is placed halfway the hydraulic supply lines in order to be able to deactivate the driving sections that are located behind the controllable valve. In the current embodiment of the current invention there is provided a plurality of controllable valves inside the valve section to allow for individually feeding hydraulic fluid to each part, which is rendered possible by the hydraulic bypass supply line that directly feeds the valve section. This offers an even greater flexibility to the downhole tractor. For more details about the respective valves and variations reference is made to the detailed description of the figures.

In an embodiment of the downhole tractor in accordance with the invention the valve section comprises a relief valve for dumping hydraulic fluid from the respective part of the second hydraulic supply line to tank. Placing the relief valve in the valve section (instead of or in place of in the hydraulic power pack) increases the number of modes of the downhole tractor even more, because it allows for deactivating both parts of the second hydraulic supply line, as will be discussed in the detailed description of the figures. The relief valve can be preset or electrically proportionally controlled. In the case of an electrically proportionally controlled relief valve this gives extra flexibility and functionality (i.e. Weight on bit control from the surface).

In an embodiment of the downhole tractor in accordance with the invention the first hydraulic supply line is terminated at a side facing the hydraulic power pack for allowing hydraulic fluid only to flow to the plurality of hydraulic cylinders via the hydraulic bypass supply line. Termination of the first hydraulic supply line at the side facing the hydraulic power pack is rendered possible, because of the presence of the hydraulic bypass supply line that directly feeds the valve section. As a consequence the first part of the first hydraulic supply line is fed from the side of the valve section.

In an embodiment of the downhole tractor in accordance with the invention the second hydraulic supply line is coupled to the hydraulic power pack via a check valve for i) allowing hydraulic fluid to be directly fed into second hydraulic supply line via the hydraulic power pack in a first operational mode of the downhole tractor and for ii) preventing hydraulic fluid to flow back into the hydraulic power pack in a second operational mode of the downhole tractor, wherein hydraulic fluid flows to the second hydraulic supply line via the hydraulic bypass supply line and the pressure-setting valve. In this embodiment the second hydraulic supply line can be fed in different ways, namely directly from the hydraulic power pack (possible supplemented with excess hydraulic fluid from the first hydraulic supply line through) or only from the hydraulic bypass supply line and the pressure-setting valve, wherein the check valve blocks the stream towards the hydraulic power pack.

In an embodiment of the downhole tractor in accordance with the invention the first hydraulic supply line comprises a bidirectional hydraulic supply line. This embodiment constitutes the most common implementation.

In an embodiment of the downhole tractor in accordance with the invention the second hydraulic supply line comprises a unidirectional hydraulic supply line. This embodiment constitutes the most common implementation.

In an embodiment of the downhole tractor in accordance with the invention each hydraulic cylinder is configured for actuating at least one tractor arm or other hydraulic actuator. This embodiment constitutes the most common implementation. Even though the description describes the actuation of arms, the invention is not limited to the actuation of arms only.

In an embodiment of the downhole tractor in accordance with the invention each hydraulic motor is configured for rotating at least one tractor wheel or other hydraulic rotatable tool. This embodiment constitutes the most common implementation. Even though the description describes the actuation of tractor wheels, the invention is not limited to the actuation of tractor wheels only.

In an embodiment of the downhole tractor in accordance with the invention the hydraulic system further comprises a further hydraulic bypass supply line coupled to the hydraulic power pack for supplying the hydraulic fluid directly to a further inlet of the valve section bypassing at least part of the first hydraulic supply line and the second hydraulic supply line. In this specification there is focus on implementing a first hydraulic bypass supply line to run from the hydraulic power pack to the valve section. However, in the same line of thought a second hydraulic bypass supply line may be implemented as in this embodiment. This then opens up the possibility to apply the bypass feature similar to the second hydraulic supply line as it is done for the first hydraulic supply line as shown in the examples. This opens up for more functionality and flexibility in individually controlling the hydraulic supply lines.

An embodiment of the downhole tractor in accordance with the invention further comprises at least one pressure sensor for monitoring pressure in a respective one of the hydraulic supply lines and hydraulic bypass supply line. Preferably, each of said supply lines comprises such pressure sensor. The advantage of using such pressure sensors is that this allows for better status control of the downhole tractor. Data from these pressure sensors can be transmitted to the surface such that the operator (or operator system) is able to monitor the status of the downhole tractor more accurately.

BRIEF INTRODUCTION OF THE DRAWINGS

In the following is described examples of embodiments illustrated in the accompanying drawings, wherein.

DETAILED DESCRIPTION OF THE EMBODIMENTS

Figure 1:
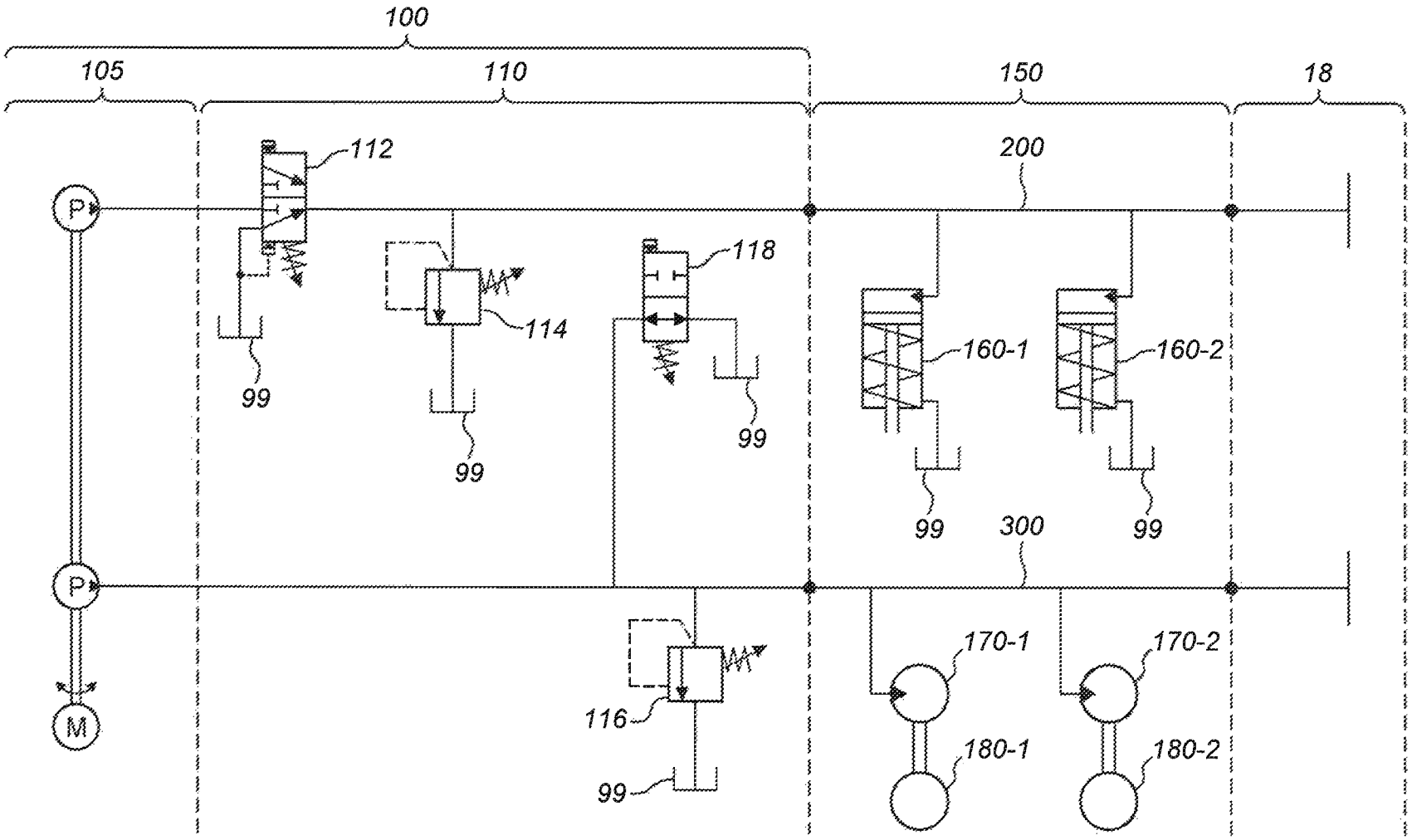
Prior Art Fig. 1
FIG. 1 shows a downhole tractor having a hydraulic system as known from the prior art.

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Hydraulic tractor systems are typically built up as follows:

1. An electronics unit—This unit communicates with the surface panels, transfers sensor data (such as pressure data) from the instrumented part of the tractor and controls activation and propulsion of the tractor system, including steering and control of the signals on the electric cables that are distributed throughout the tractor.

2. A motor unit—This unit includes the electromotor, the hydraulic pump and the manifold for generating and distributing the hydraulic propulsion pressure.

3. Driving sections—This unit includes two or more arm systems per driving section.

4. A compensator—This unit regulates the internal pressure in relation to the ambient pressure of the system, and feeds hydraulic oil to compensate for leakage.

There exist hydraulic systems having only one hydraulic circuit (a hydraulic supply line with a return line). In these systems the single hydraulic circuit activates both the pivotable arms as well as the wheels. A bypass line in such systems may also extend the functionality in a limited manner switching on and off sections but would not allow independent control of drive wheels.

The invention primarily aims at improving hydraulic systems having two hydraulic circuits, i.e. two hydraulic supply lines, wherein one hydraulic supply line activates the pivotable arms and the other hydraulic supply line activates the wheels.

The hydraulic system uses hydraulic power generated by an electric motor and a pump. The pump generates volume and pressure to two different separated hydraulic circuits, whereas the manifold that is coupled to the pump regulates the pressure as well as the on- and off-function.

At the start-up of the hydraulic system the hydraulic pressure is generated by the motor/pump system and provided to the arm and wheel propulsion. The arm pressure is held constant at a predefined level and any excess volume is fed to the tank. The biggest (hydraulic) volume is fed to the wheel motors for propulsion of the system. The whole hydraulic circuit is optimized for minimal friction and for maximal use of the available hydraulic power. The wheel motors, the gearing ratio from the motors to the wheels and the wheel size are all calculated and dimensioned to provide the desired propulsion force.

Less friction as well as a larger generated hydraulic volume in the hydraulic circuit will increase the speed of the wheel propulsion system.

FIG. 1 shows a downhole tractor having a hydraulic system as know from the prior art. The hydraulic system shows a hydraulic power pack 100 that is configured for driving two hydraulic supply lines 200, 300 (each forming a respective hydraulic circuit together with a supply line to (hydraulic) tank 99). The hydraulic power pack 100 comprises a motor/pump block 105 that comprises an electric motor M that drives two pumps P, and a manifold block 110 coupled to said pumps P as illustrated. The manifold block 110 comprises respective parts of said hydraulic supply lines 200, 300. The first hydraulic supply line 200 is a bidirectional hydraulic supply line and is connected to a hydraulic cylinder 160 for driving a tractor arm (not shown). The second hydraulic supply line 300 is a unidirectional hydraulic supply line and is connected to a hydraulic motor 170 for driving a tractor wheel 180. In FIG. 1 only two drive sections 150, meaning two hydraulic cylinders 160-1, 160-2, two hydraulic motors 170-1, 170-2, and two tractor wheels 180-1, 180-2 have been drawn. However, in practise this may be any other number of drive sections. A typical number of drive sections 150 for a downhole tractor is eight.

The manifold block 110 comprises a (3-port) sequence valve 112 and a relief valve 114 connected to the first hydraulic supply line 200 as illustrated. The relief valve 114 is configured for holding the correct pressure on the first hydraulic supply line 200 as earlier discussed. Both the sequence valve 112 and the relief valve 114 are connected to tank 99 as illustrated. The manifold block 110 further comprises a further relief valve 116 and a further sequence valve 118 connected to the second hydraulic supply line 300 as illustrated. Both the further relief valve 116 and the further sequence valve 118 are connected to tank 99 as illustrated.

Figure 2:
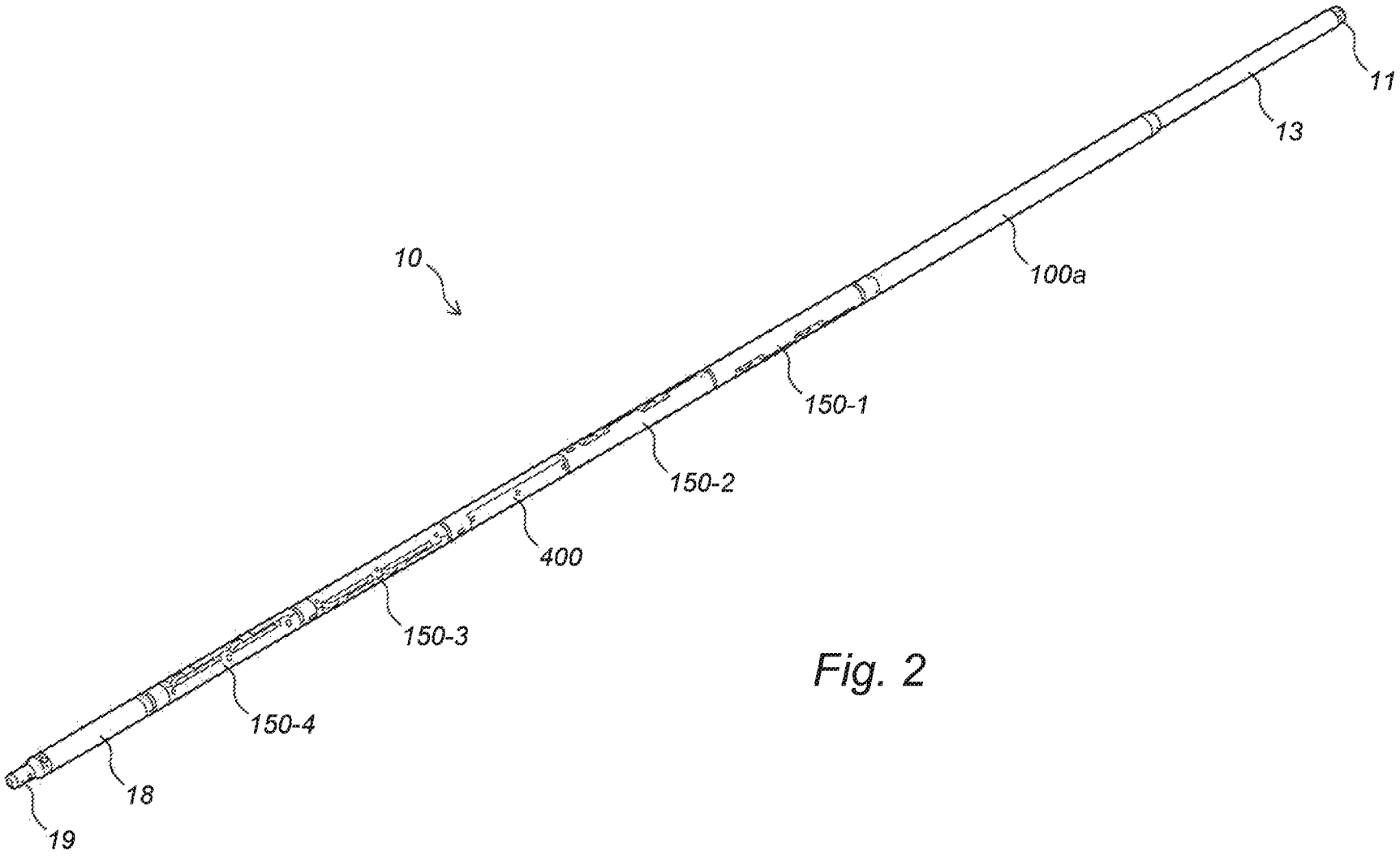
FIG. 2 shows an embodiment of a downhole tractor in accordance with the invention.

FIG. 2 shows an embodiment of a downhole tractor 10 in accordance with the invention.

The downhole tractor 10 comprises a plurality of modules that are connected together, which is a common way downhole tractors are made. It must be stressed, however, that the invention is not limited to modularly-built downhole tractors. The downhole tractor comprises a top module 11 (also called top sub). This top module 11 forms the interface with the wireline (not shown) to the surface. The top module 11 is connected to a telemetry module 13, which is configured for the telemetric communication with the surface through the wireline (including the transmission of sensor data to the surface). The telemetry module 13 is connected to hydraulic power pack 100*a*, which comprises a motor module and a motor controller. As will be discussed later in the detailed description, the hydraulic power pack 100*a* of the invention may be adapted in comparison with the hydraulic power pack 100 of the prior art as shown in FIG. 1.

The hydraulic power pack 100*a* is connected to a series connection of two drive modules (sections) 150-1, 150-2, also being referred to as the upper drive sections. The second upper drive sections 150-2 is connected to a valve module 400, which is a new feature of the downhole tractor 10 of the invention that has not been reported in the prior art before. That is to say a valve module in between drive sections. The valve module 400 is further connected to a series connection of two further drive modules (sections) 150-3, 150-4, also being referred to as the lower drive sections. The lowest drive section 150-4 is connected to a terminal module 18 (also called compensator sub), which on its turn is connected to a bottom module 19 (or bottom sub). This downhole tractor 10 comprises a hydraulic system that extends from the hydraulic power pack 100*a* all the way to the compensator sub 18.

Figure 3:
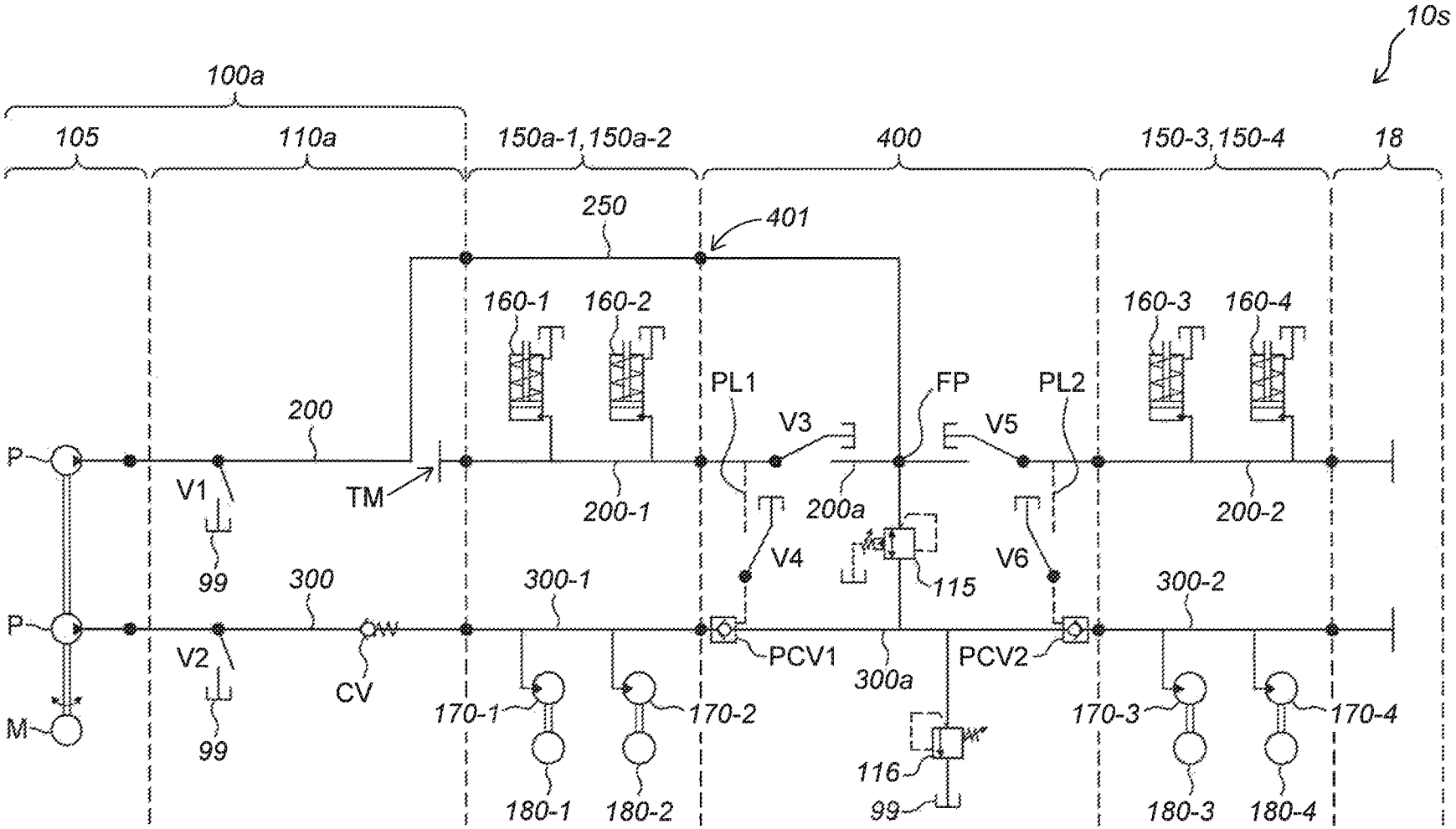
FIG. 3 shows the hydraulic system of the downhole tractor of FIG. 2, and FIGS. 4 to 9 illustrate what happens in the hydraulic system in different operational modes of the downhole tractor.

FIG. 3 shows the hydraulic system 10*s* of the downhole tractor of FIG. 2. The hydraulic system 10*s* comprises an adapted hydraulic power pack 100*a* that is connected to two (modified) upper drive sections 150*a*-1, 150*a*-2. The upper drive sections 150*a*-1, 150*a*-2 on their turn are connected to a (specially designed) valve module 400, which on its turn is connected to two (not necessarily modified) lower drive sections 150*a*-3, 150*a*-4. The chain of (hydraulic) modules is closed by the terminal module 18. It must be noted that a different number of upper and lower drive sections could be chosen, for example six or eight. Each drive section 150*a*-1, 150*a*-2, 150-3, 150-4 comprises a respective hydraulic cylinder 160-1 . . . 160 . . . 4, a respective hydraulic motor 170-1 . . . 170-4, and a respective tractor wheel 180-1 . . . 180-4, similar to the drive sections as known from the prior art. It must be also noted that for the lower drive sections 150-3, 150-4 of the downhole tractor 10, the modified drive sections 150*a*-1, 150*a*-2 (with a hydraulic bypass supply line) could be used. However, in that case the termination module 18 needs to be adapted in that it also properly terminates the hydraulic supply line 250.

The upper drive sections 150*a*-1, 150*a*-2 have been amended in that these comprise a hydraulic bypass supply line 250. The hydraulic bypass supply line 250 is a new feature that has not been reported in the prior art before. It is this extra line 250, which in combination with the valve module 400 opens up a tremendous amount of extra options.

The valve module 400 effectively divides the first hydraulic supply line 200 in a first part 200-1 (within the upper drive sections 150*a*-1, 150*a*-2) and a second part 200-2 (within the lower drive sections 150-3, 150-4). Similarly, the valve module 400 effectively divides the second hydraulic supply line 300 in a first part 300-1 (within the upper drive sections 150*a*-1, 150*a*-2) and a second part 300-2 (within the lower drive sections 150-3, 150-4). Consequently, within the valve module 400 there is respective parts 200*a*, 300*a* of the respective hydraulic supply lines 200, 300 that connected the respective first parts 200-1, 300-1 with the respective second parts 200-2, 300-2.

The hydraulic bypass supply line 250 is fed into an inlet 401 of the valve module 400, which then leads this line towards a feeding point FP on the respective part 200*a* of the first hydraulic supply line 200 as illustrated.

FIG. 3 further shows that the adapted hydraulic power pack 100*a* comprises an adapted manifold block 110*a* and motor/pump block 105, which may be the same as in the prior art, comprising one motor M, an axle, two pumps P driven by the motor M, and two hydraulic power supply lines 200, 300 driven by said pumps P as illustrated. The adapted manifold block 110*a* comprises a first controllable switch V1 coupled between the first hydraulic supply line 200 and tank 99. A similar controllable switch V2 is coupled between the second hydraulic supply line 300 and tank 99. In an embodiment the first switch V1 and the second switch V2 are 2-position, 2-port normally-closed type valves (for example solenoid valves in order to define clearly what is meant with a valve being "open" or "closed", the following definition is given for this specification. When a valve is "open" it allows flow through it. In a three-port valve this means that the flow is not connected to return/tank. When a valve is "closed" this means that the valve does not allow flow through it OR it is connected to return/tank.

The purpose of the first and second controllable switches V1, V2 is to be able to selectively dump the respective hydraulic fluid in the respective hydraulic supply lines 200, 300 to tank for the purpose of changing the operational mode of the tractor as will be explained later.

The adapted manifold block 110*a* further comprises a rerouting of the first hydraulic supply line 200 to the hydraulic bypass supply line 250 in the upper drive sections 150*a*-1, 150*a*-2. Furthermore, the manifold block 110*a* comprises a termination TM for terminating the first hydraulic supply line 200. This termination is illustrated in the manifold block 110*a*, but it might also have been placed within the most upper drive section 150*a*-1.

The adapted manifold block 110*a* further comprises a check valve CV in the second hydraulic supply line 300 as illustrated. The function of the check valve CV is to allow hydraulic fluid to flow from the left to the right, but not in the opposite direction. The purpose of this check valve will be explained with reference to FIGS. 4 to 9.

The main purpose of the valve module 400 is to receive the hydraulic fluid from the hydraulic bypass supply line 250 and to distribute it for the respective parts 200-1, 200-2, 300-1, 300-2 of the hydraulic supply lines 200, 300. However, a further purpose is to be able to individually control a flow of hydraulic fluid in each of said parts 200-1, 200-2, 300-1, 300-2. In order to achieve that an implementation of the valve module 400 as shown in FIG. 3 may be chosen. The valve module 400 comprises a plurality of controllable switches V3, V4, V5, V6 (which may be 2-position, 3-port valves in an embodiment) as shown. Furthermore, the valve module 400 comprises two piloted check-valves PCV1, PCV2 in the second hydraulic supply line 300 as shown. These piloted check-valves PCV1, PCV2 are the components that enables or disable hydraulic fluid flow in the respective parts 300-1, 300-2 of the second hydraulic supply line 300. The piloted check-valves PCV1, PCV2 are controlled by respective first and second pilot lines PL1, PL2 as illustrated. Two of said earlier mentioned controllable switches V4, V6 have been provided in these pilot lines PL1, PL2 as illustrated. These controllable switches in V4, V6 in the pilot lines PL1, P12, enable an extra set of operational modes of the downhole tractor 10 as will be illustrated in the discussion of FIGS. 4 to 9. In addition, a pressure-setting valve 115 is provided in between the first hydraulic supply line 200 and the second hydraulic supply line 300, which is configured for feeding excess hydraulic fluid in the first hydraulic supply line 200 to the second hydraulic supply line 300. It must be stressed that the embodiment in FIG. 3 is just one of many implementations of the function to be able to individually control hydraulic fluid flow in each of the respective parts 200-1, 200-2, 300-1, 300-2 of the hydraulic supply lines. The valve modules 400 further comprises a relief valve 116 between the second hydraulic supply line 300 and tank 99 as illustrated. The purpose of this valve 116 is to regulate the pressure in the second hydraulic supply line 300. In the prior art solutions this valve is placed in the manifold block 110. In the illustrated embodiment of the invention this valve 116 is to be placed in the valve module 400 in between said drive sections 150*a*-1, 150*a*-2, 150-3, 150-4.

FIGS. 4 to 9 illustrate what happens in the hydraulic system in different operational modes of the downhole tractor. These figures are similar to FIG. 3, with the exception that the respective switches are in different positions. Some reference numerals have been left out to facilitate reading of the figures.

Figure 4:
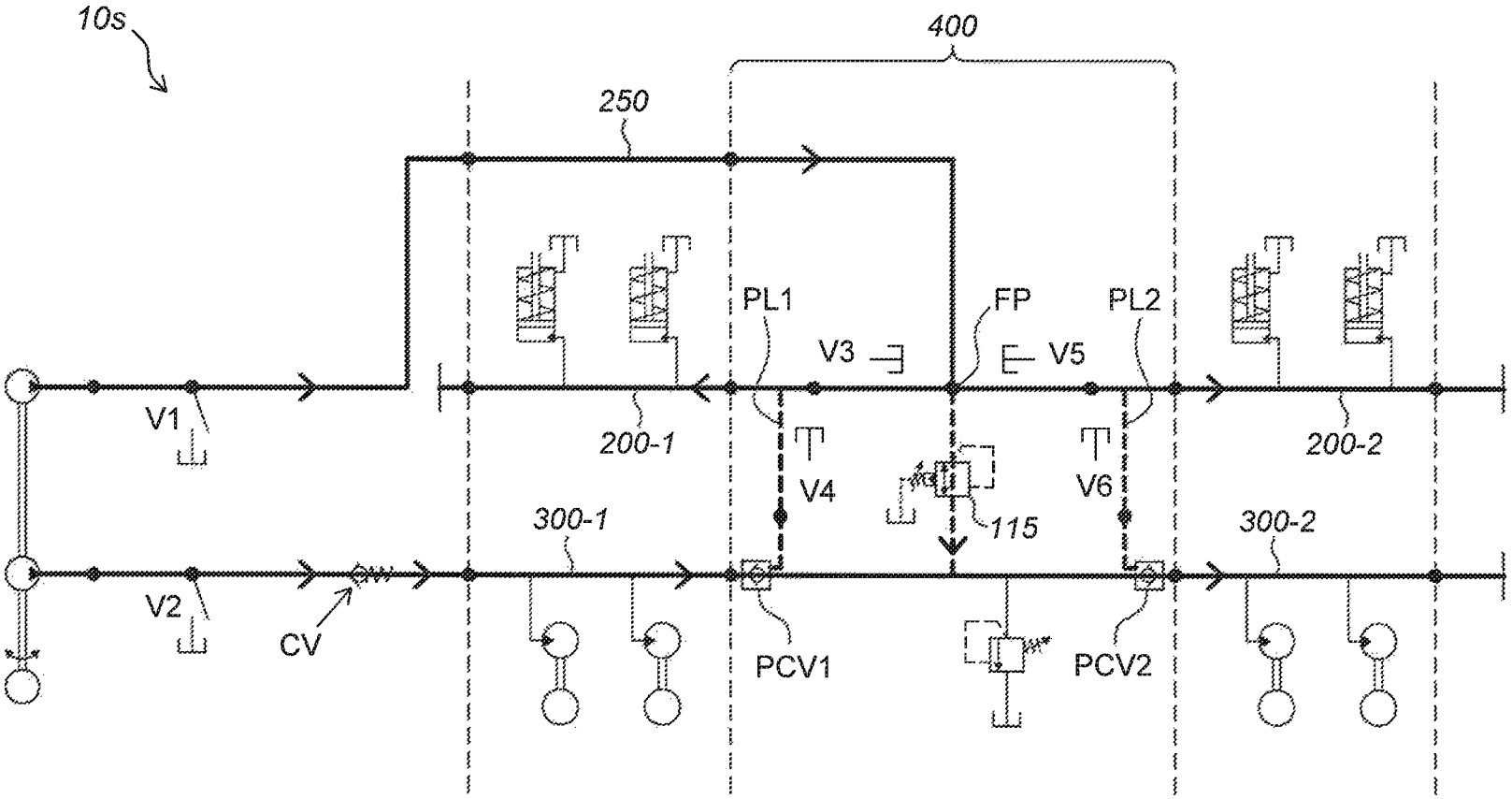

FIG. 4 shows the standard tractor mode. Switch (valve) V1 and switch (valve) V2 are closed, allowing the hydraulic fluid to flow at normal pressure into hydraulic bypass supply line 250 and the first part 300-1 of the second hydraulic supply line 300. Switch (valve) V3 and switch (valve) V5 are open, allowing the hydraulic fluid to flow from the hydraulic supply line 250 to the feeding point FP into and into the first part 200-1 and the second part 200-2 of the first hydraulic supply line 200. Switch V4 and V6 are also open, allowing the hydraulic fluid to activate the piloted check-valves PCV1, PCV2 through the pilot lines PL1, PL2, thereby opening said check-valves. Consequently, the hydraulic fluid in the second hydraulic supply line 300 can flow through the first part 300-1 through the valve module 400 into the second part 300-2 of the second hydraulic supply line 300. The pressure-setting valve 115 feeds possible excess hydraulic fluid (pressure) towards the second hydraulic supply line 300, which increases the conveyance speed of the tractor. The arrows in FIG. 4 illustrate the flow direction of hydraulic fluid. One important footnote FIGS. 4 to 9 is that the first hydraulic supply line 200 may typically be bidirectional hydraulic supply line, which means that the flow in that line may be reverse, when the hydraulic cylinders are being emptied to tank 99.

Figure 5:
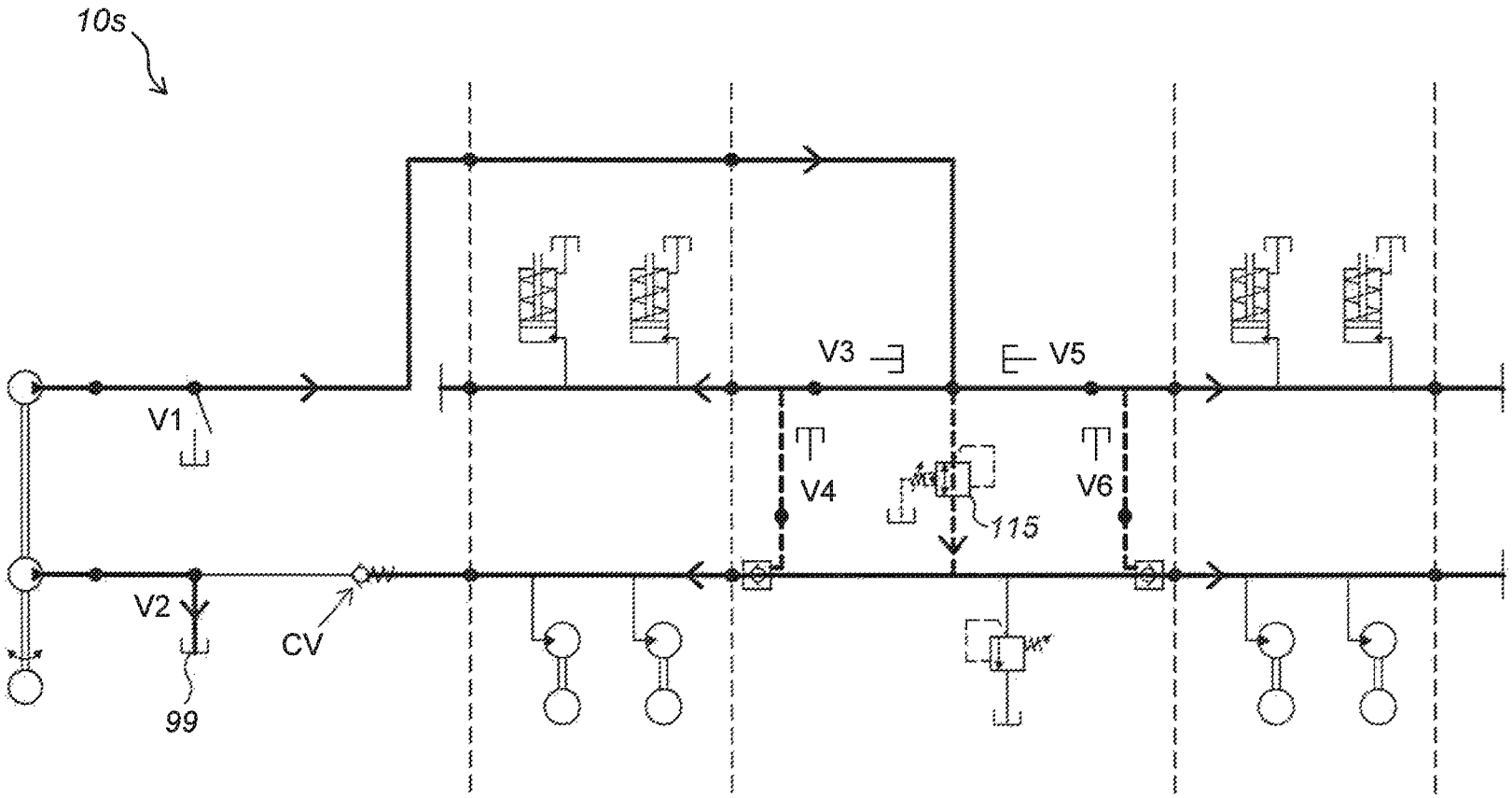

FIG. 5 shows the standard tractor low-speed (low power) mode. The difference between this mode and the standard tractor mode in FIG. 4 is that the second switch V2 is now open, dumping the hydraulic fluid to tank 99. Consequently, the second hydraulic supply line 300 is now only fed through the pressure-setting valve 115. The arrows in FIG. 5 illustrate the flow direction of hydraulic fluid. The check valve CV is now blocking the hydraulic fluid in the second hydraulic supply line 300 to flow back to the pump. The flow in the second hydraulic supply line 300 is now lower than in FIG. 4, which sets the tractor in low-speed (or low-power) mode.

Figure 6:
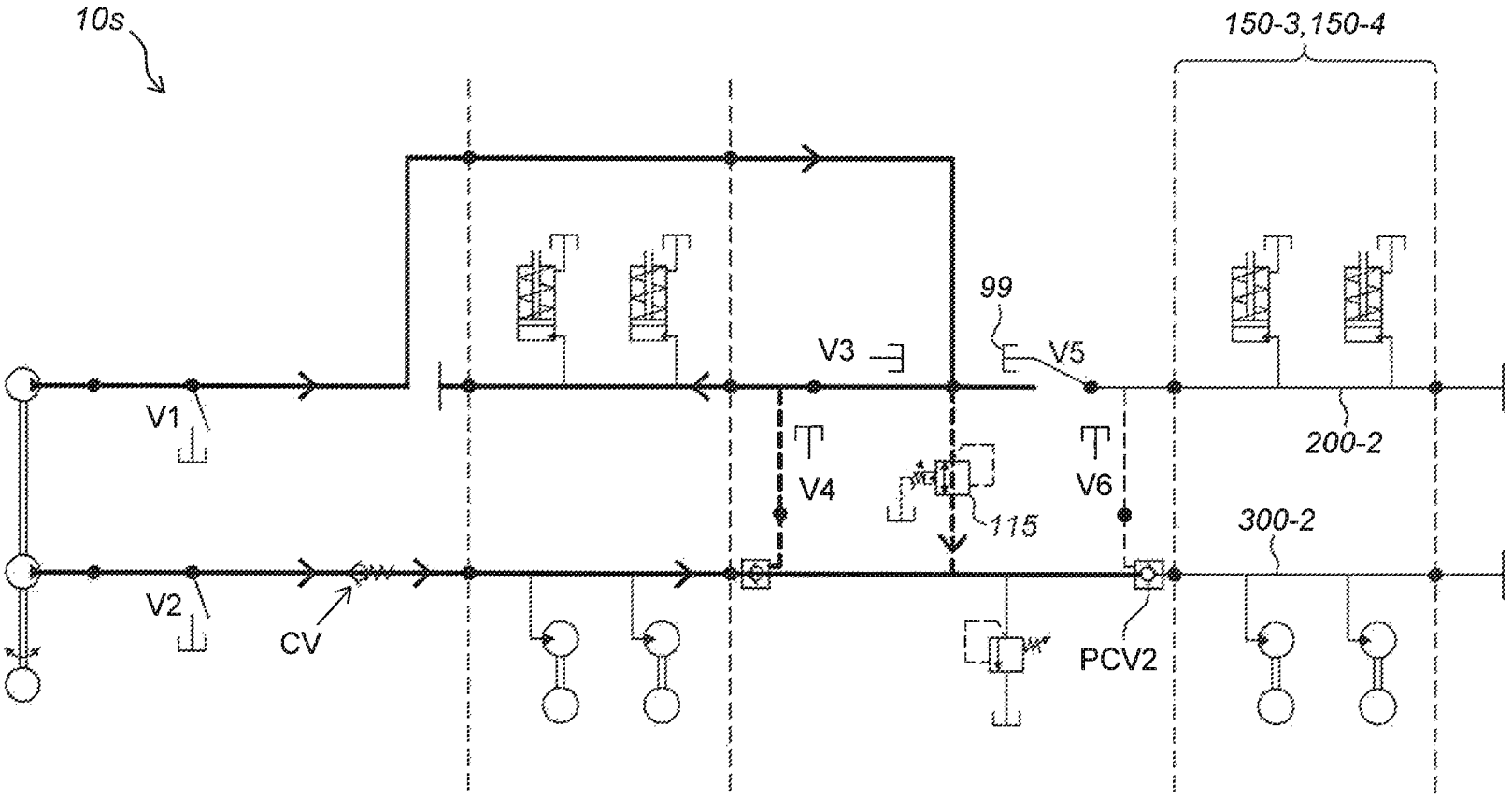

FIG. 6 shows the tandem tractor upper high-speed mode. The difference between this mode and the standard tractor mode in FIG. 4 is that the switch valve V5 is now closed, i.e. dumping to tank 99. Consequently, both the second part 200-2 of the first hydraulic supply line 200 as well as the second pilot line PL2 are shut-off. The latter also causing the second part 300-2 of the second hydraulic supply line 300 being shut-off, i.e. deactivating the lower drive sections 150-3, 150-4.

Figure 7:
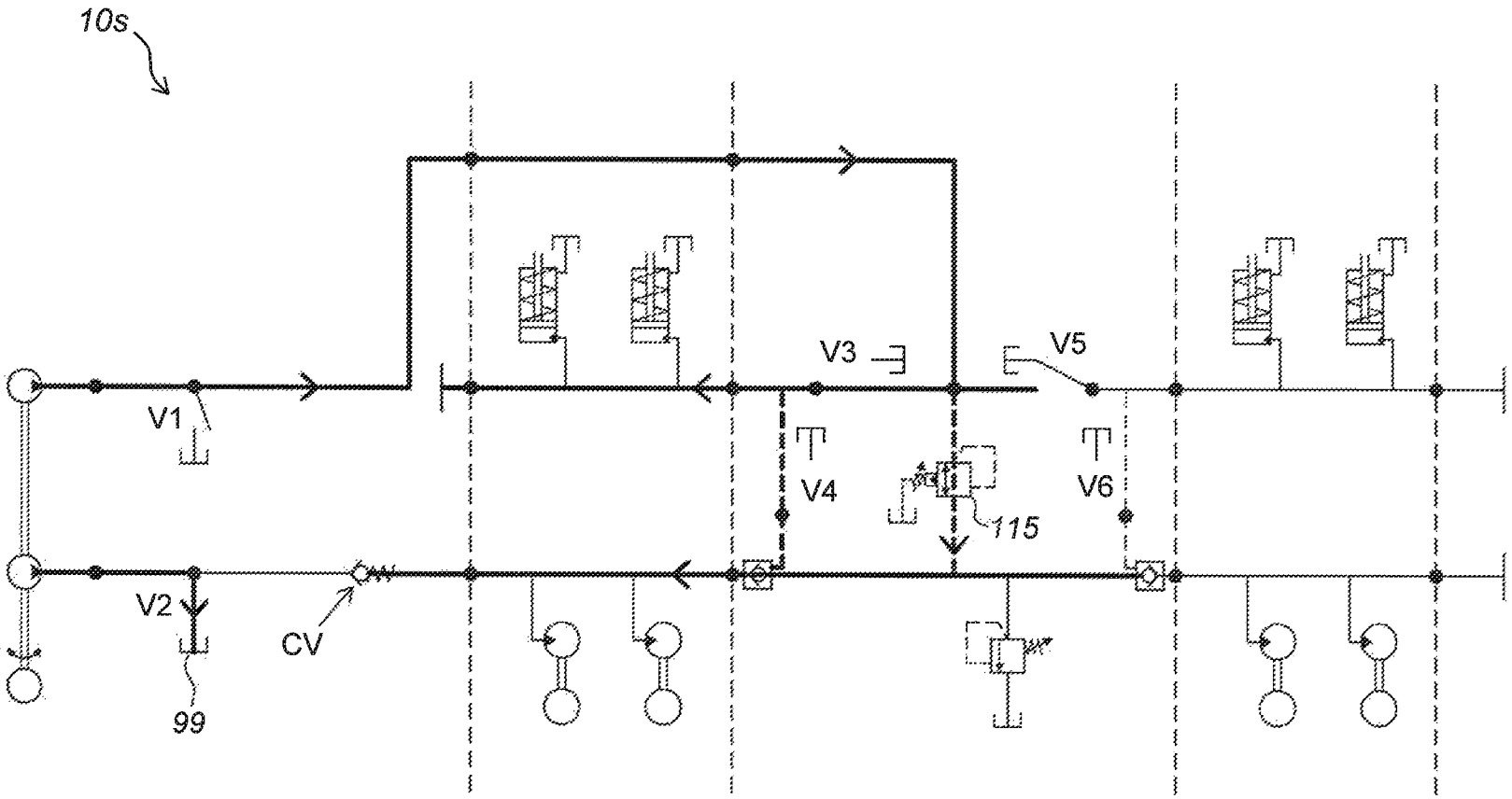

FIG. 7 shows the tandem tractor upper low-speed mode. The difference between this mode and the standard tractor mode in FIG. 6 is that the second switch valve V2 is now open, i.e. dumping the hydraulic fluid to tank 99. Consequently, the second hydraulic supply line 300 is now only fed through the pressure-setting valve 115. The arrows in FIG. 7 illustrate the flow direction of hydraulic fluid. The check valve CV is now blocking the hydraulic fluid in the second hydraulic supply line 300 to flow back to the pump. The flow in the second hydraulic supply line 300 is now lower than in FIG. 6, which sets the tractor in low-speed (or low-power) mode.

Figure 8:
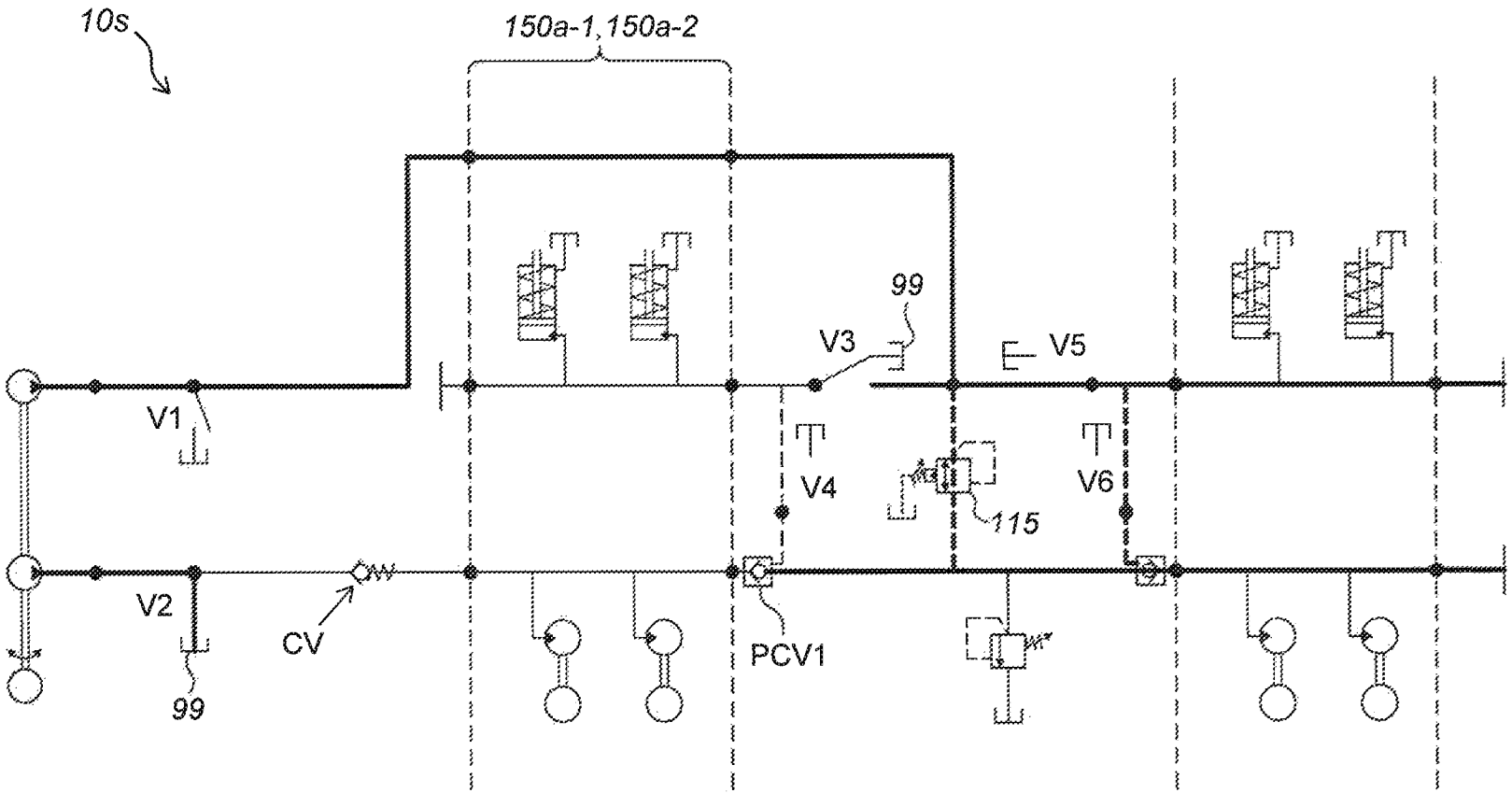

FIG. 8 shows the tandem tractor lower (low-speed) mode. The difference between this mode and the low-speed tractor mode of FIG. 5 is that the third switch valve V3 is now closed, dumping the hydraulic fluid to tank 99. The first piloted check-valve PCV1 is closed. Consequently, the upper drive sections 150*a*-1, 150*a*-2 are deactivated.

Figure 9:
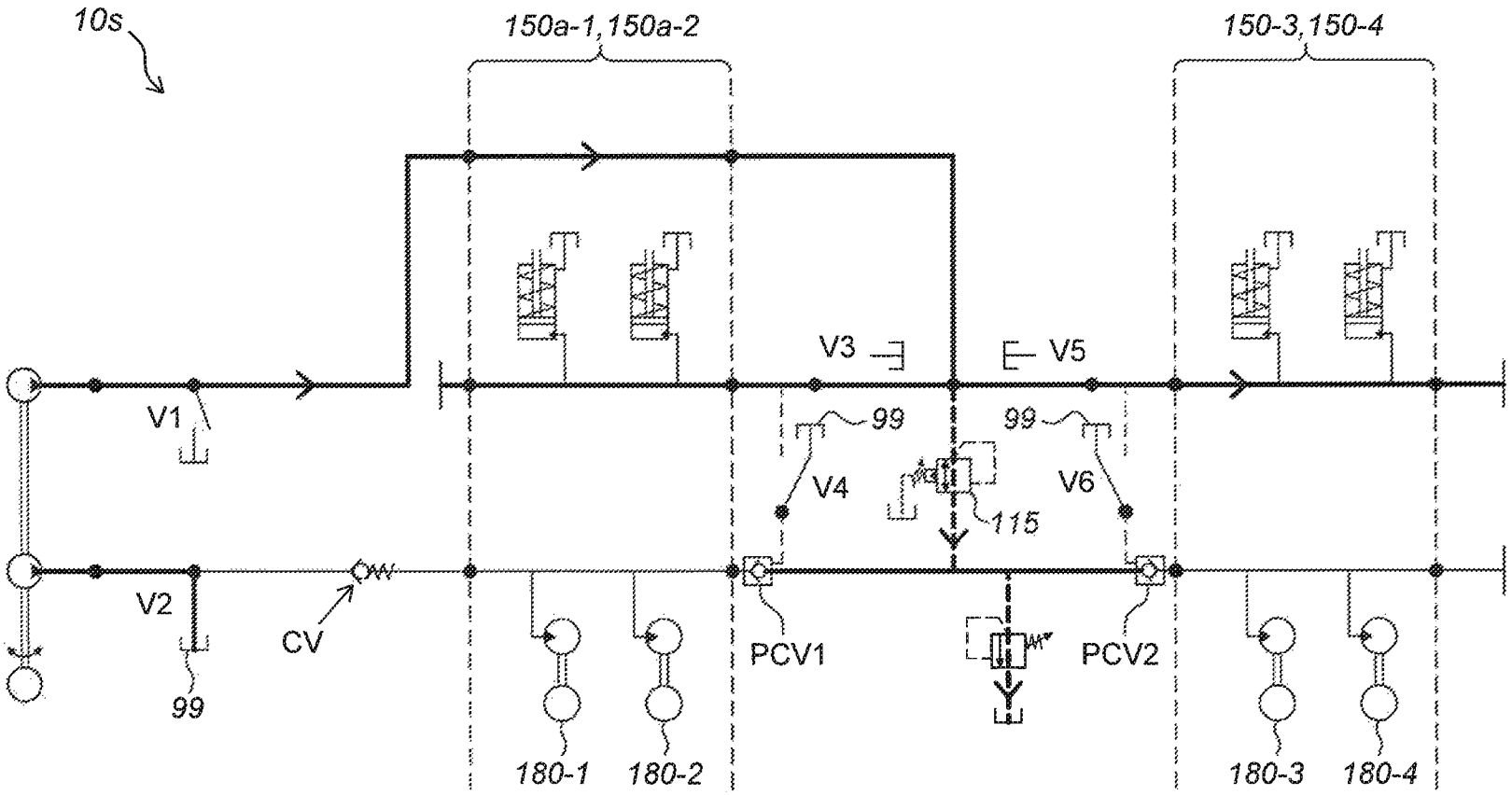

FIG. 9 shows the rolling anchor mode, wherein the wheels 180-1 . . . 180-4 in the driving sections 150*a*-1, 150*a*-2, 150-3, 150-4 are not driven, while all arms are pressed out. In order to achieve this mode, the controllable switch valves V4, V6 in the pilot lines PL1, PL2 are required, when piloted check-valves PCV1, PCV2 are used as in FIG. 9. Both controllable switch valves V4, V6 are closed, i.e. dumping to tank 99, while valves V3 and V5 are open. In addition, the second controllable valve V2 in the manifold block needs to be dumping to tank 99, otherwise wheels 180-1, 180-2 of the upper drive sections 150*a*-1, 150*a*-2 would still be driven.

As discussed in view of the figures, the downhole tractor in accordance with the invention has upper and lower drive sections separated by a valve module, wherein the number of upper and lower sections is flexible (for instance two as illustrated).

As has been explained, the downhole tractor can run as a normal 4-section tractor, and using the adapted manifold (part of hydraulic power pack) it has become very flexible.

The wireline tractor of the invention can also run with just the upper sections powered and the lower sections closed (tandem tractor upper mode). This gives the benefit of extra speed but it also means that the downhole tractor can push the closed lower sections past impassable obstructions (for example the Side Pocket challenge), where after the downhole tractor may be switched to the tandem tractor lower mode (lower sections powered and upper sections closed). The length of the valve module 400 actually is a benefit to ensure the lower sections have passed the obstacle.

If needed the downhole tractor of the invention could be fitted in the lower sections with reverse arms so that the tractor goes forward with the upper sections powered or in reverse with the lower sections powered.

In the table below there the various operational modes (including the ones that have been discussed with reference to FIGS. 4 to 9) that are possible with the embodiment of FIG. 3 are listed. This list is not exhaustive, but rather illustrative for what possibilities the invention creates. A "1" indicates that the valve is dumping to tank and a "0" indicates the other mode. The five modes mentioned at the bottom are modes that become possible if the lower drive sections are hard-wired such that the motors are in (permanent) reverse mode.

TABLE

Operational modes of an embodiment of the downhole tractor in accordance with the invention.

| Operational Modes | Hydraulic power pack | | Valve section | | | |
|---|---|---|---|---|---|---|
| | V1 | V2 | V3 | V4 | V5 | V6 |
| All drive section forward | | | | | | |
| Motor Turning, No arm force, No wheel drive | 1 | 1 | 0 | 0 | 0 | 0 |
| Arms out, No wheel drive (rolling anchor) (FIG. 9) | 0 | 1 | 0 | 1 | 0 | 1 |
| Standard Tractor Full Flow (FIG. 4) | 0 | 0 | 0 | 0 | 0 | 0 |
| Standard Tractor Low speed (driven from arm force) (FIG. 5) | 0 | 1 | 0 | 0 | 0 | 0 |
| All Arms Open, Upper sections driving, Hi Speed | 0 | 0 | 0 | 0 | 0 | 1 |
| All Arms Open, Upper sections driving, Lo Speed | 0 | 1 | 0 | 0 | 0 | 1 |
| All Arms Open, Lower sections driving, Lo Speed | 0 | 1 | 0 | 1 | 0 | 0 |
| Tandem-Upper Sections Driven (lower closed), Hi speed (FIG. 6) | 0 | 0 | 0 | 0 | 1 | 0 |
| Tandem-Upper Sections Driven (lower closed), Lo speed (FIG. 7) | 0 | 1 | 0 | 0 | 1 | 0 |
| Tandem-Lower Sections Driven (upper sections closed) (FIG. 8) | 0 | 1 | 1 | 0 | 0 | 0 |
| Lower drive sections in reverse (hard-wired) | | | | | | |
| Tandem-Upper Sections Driven (lower closed), Hi speed | 0 | 0 | 0 | 0 | 1 | 0 |
| Tandem-Upper Sections Driven (lower closed), Lo speed | 0 | 1 | 0 | 0 | 1 | 0 |
| Tandem-Lower Sections Driven Reverse (upper closed) | 0 | 1 | 1 | 0 | 0 | 0 |
| All Arms Open, Upper Driving, Lo Speed Shuttle Forward | 0 | 1 | 0 | 0 | 0 | 1 |
| All Arms Open, Lower Driving, Lo Speed Shuttle Reverse | 0 | 1 | 0 | 1 | 0 | 0 |

Furthermore, there are many variations possible with respect to the example embodiments here discussed. For example, the rerouting and the termination TM in FIG. 3 could be replaced by a 3-port valve and a termination allowing the hydraulic fluid to flow either in the first hydraulic supply line 200-1 (normal tractor operation) or the hydraulic bypass supply line 250. In another embodiment the relief valve controlling pressure in the secondary hydraulic line 300*a* can be an electrically controlled proportional relief valve. This adds even more flexibility and functionality (i.e. Weight on bit control) allowing the tractor drive pull to be remotely controlled.

In a first variant the downhole tractor only has one hydraulic supply line instead of two (as is the case in the detailed description and the claims) in addition to the hydraulic bypass supply line. The bypass effect of the invention still applies in such embodiment.

In a further variant the invention can be further extended in that at least one of the respective drive sections (comprising the hydraulic cylinders and the hydraulic motors may be replaced by other types of hydraulically-actuated equipment that can be turned on and off. Such piece of equipment may be placed both upstream as well as downstream of the valve section in order to benefit from the invention (i.e. to become individually controllable). Examples of such equipment are further hydraulic operated modules, pistons, motors, anchors, centralizers, actuators, and the like.

The claims and description are focussed on implementing a first hydraulic bypass supply line to run from the hydraulic power pack to the valve section. However, in the same line of thought a second hydraulic bypass supply line may be implemented, whenever there is place for such line in the downhole tractor. This then opens up the possibility to apply the bypass feature similar to the second hydraulic supply line as it is done for the first hydraulic supply line as shown in the examples. This means that the second bypass supply line is then connected to a further inlet coupled to a further feeding point in the second hydraulic supply line within the valve section. This renders the check valve in the second hydraulic supply line optional as the first part of the second hydraulic supply line now always can be fed via the valve block.

In a further variant the invention may be further extended in that there is provided two or more valve sections distributed over the length of the downhole tractor, each valve section being configured similar to the valve section as discussed in the figure description. The hydraulic bypass supply line in this embodiment is connected to inlets of the respective valve sections in order to provide hydraulic fluid directly thereto. The respective hydraulic supply lines may be provided with termination in order to divide said supply lines in part, such that they can be fed through the respective valve section that are connected to them.

In view of the above-mentioned variations the invention, in accordance with a second aspect, also relates to a downhole tractor comprising a hydraulic system for driving a plurality of hydraulic components (such as hydraulic cylinders and hydraulic motors), wherein the hydraulic system comprises:

- a hydraulic power pack;
- a hydraulic supply line for supplying hydraulic fluid to the plurality of hydraulic components;
- a valve section comprising respective parts of said hydraulic supply line, and an inlet for receiving the hydraulic fluid, and a set of valves, and
- a hydraulic bypass supply line coupled to the hydraulic power pack for supplying the hydraulic fluid directly to the inlet of the valve section bypassing at least part of the hydraulic supply line;
- wherein the hydraulic supply line comprises a first part and a second part that are connected via the valve section, wherein the first part of the hydraulic supply line is connected to a sub-set of the plurality of hydraulic components, wherein the second part of the hydraulic supply line is connected to a further sub-set of the plurality of hydraulic components, wherein the valve section is configured for individually controlling flow of the hydraulic fluid into each respective part of the hydraulic supply line.

The downhole tractor in accordance with the second aspect benefits from similar embodiments as mentioned for the downhole tractor in accordance with the first aspect.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope of the invention. Accordingly, the protection sought herein is as set forth in the claims below.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does to not exclude the presence of a plurality of such elements. The mere fact that certain measures are recited in mutually different dependent claims does not indicate that a combination of these measures cannot be used to advantage. In the device claim enumerating several means, several of these means may be embodied by one and the same item of hardware.

The invention claimed is:

1. Downhole tractor comprising a hydraulic system for driving a plurality of hydraulic cylinders and a plurality of hydraulic motors, wherein the hydraulic system comprises:

a hydraulic power pack;

a first hydraulic supply line for supplying hydraulic fluid to the plurality of hydraulic cylinders;

a second hydraulic supply line for supplying the hydraulic fluid to the plurality of hydraulic motors;

a valve section comprising a respective part of the first hydraulic supply line and a further respective part of the second hydraulic supply line, and the valve section further comprising an inlet for receiving the hydraulic fluid, and a plurality of valves, and a hydraulic bypass supply line coupled to the hydraulic power pack for supplying the hydraulic fluid directly to the inlet of the valve section bypassing at least part of the first hydraulic supply line and the second hydraulic supply line;

wherein the first hydraulic supply line comprises a first part and a second part that are connected via the respective part in the valve section, wherein the first part of the first hydraulic supply line is connected to a sub-set of the plurality of hydraulic cylinders, wherein the second part of the first hydraulic supply line is connected to a further sub-set of the plurality of hydraulic cylinders, wherein the second hydraulic supply line comprises a first part and a second part that are connected via the further respective part in the valve section, wherein the first part of the second hydraulic supply line is connected to a sub-set of the plurality of hydraulic motors, wherein the second part of the second hydraulic supply line is connected to a further sub-set of the plurality of hydraulic motors, wherein the valve section is configured for individually controlling flow of the hydraulic fluid into each respective part of the hydraulic supply lines.

2. The downhole tractor in accordance with claim 1, wherein the valve section comprises a pressure-setting valve provided in between the respective part of the first hydraulic supply line and the respective part of the second hydraulic supply line, the pressure-setting valve being configured for feeding excess hydraulic fluid in the first hydraulic supply line to the second hydraulic supply line.

3. The downhole tractor in accordance with claim 1, wherein the valve section comprises valves placed in said hydraulic supply lines for allowing individual control of the flow of the hydraulic fluid into each respective part of the hydraulic supply lines.

4. The downhole tractor in accordance with claim 1, wherein the valve section comprises a relief valve for dumping hydraulic fluid from the respective part of the second hydraulic supply line to a tank.

5. The downhole tractor in accordance with claim 1, wherein the first hydraulic supply line is terminated at a side facing the hydraulic power pack for allowing hydraulic fluid only to flow to the plurality of hydraulic cylinders via the hydraulic bypass supply line.

6. The downhole tractor in accordance with claim 2, wherein the second hydraulic supply line is coupled to the hydraulic power pack via a check valve (CV) for allowing hydraulic fluid to be directly fed into second hydraulic supply line via the hydraulic power pack in a first operational mode of the downhole tractor and for preventing hydraulic fluid to flow back into the hydraulic power pack in a second operational mode of the downhole tractor, wherein hydraulic fluid flows to the second hydraulic supply line via the hydraulic bypass supply line and the pressure-setting valve.

7. The downhole tractor in accordance with claim 1, wherein the first hydraulic supply line comprises a bidirectional hydraulic supply line.

8. The downhole tractor in accordance with claim 1, wherein the second hydraulic supply line comprises a unidirectional hydraulic supply line.

9. The downhole tractor in accordance with claim 1, wherein each hydraulic cylinder is configured for actuating at least one tractor arm or hydraulic actuator.

10. The downhole tractor in accordance with claim 1, wherein each hydraulic motor is configured for rotating at least one tractor wheel or hydraulic rotatable tool.

* * * * *